US006234054B1

(12) United States Patent
Heutschi

(10) Patent No.: US 6,234,054 B1
(45) Date of Patent: May 22, 2001

(54) CUTTER FOR AUTOMATIC TRIMMING OF LEAFLETS MAGAZINES AND BOOKS

(75) Inventor: Kurt Heutschi, Wikon (CH)

(73) Assignee: Grapha-Holding AG, Hergiswil (CH)

( * ) Notice: Subject to any disclaimer, the term of this patent is extended or adjusted under 35 U.S.C. 154(b) by 0 days.

(21) Appl. No.: 09/265,996

(22) Filed: Mar. 11, 1999

(30) Foreign Application Priority Data

Mar. 11, 1998 (EP) ..... 98810206

(51) Int. Cl.[7] ..... B26D 7/06

(52) U.S. Cl. ..... 83/155; 83/404.1; 83/408; 83/566

(58) Field of Search ..... 83/155, 349, 404, 83/404.1, 408, 378, 566

(56) References Cited

U.S. PATENT DOCUMENTS 5,279,196 * 1/1994 Mohr ..... 83/934

5,503,051 * 4/1996 Stauber ..... 83/409.2

* cited by examiner

*Primary Examiner*—M. Rachuba

(74) *Attorney, Agent, or Firm*—Venable; Robert Kinberg

(57) ABSTRACT

A cutter arrangement for automatically trimming flat products, such as leaflets, magazines and books transported along a horizontal path includes a clamping mechanism positioned along the path for clamping the products, respectively, during a trimming operation. A counter-knife is fixedly positioned above the horizontal path in a location corresponding to the position of the clamping mechanism and has a cutting edge. An up and down movable knife is coordinated with the clamping mechanism and positioned below the horizontal path beneath the counter-knife. The movable knife has a cutting edge for cooperating with the cutting edge of the counter-knife during an upward movement of the movable knife for trimming a respective one of the flat products clamped by the clamping mechanism.

6 Claims, 4 Drawing Sheets

CUTTER FOR AUTOMATIC TRIMMING OF LEAFLETS MAGAZINES AND BOOKS

CROSS-REFERENCE TO RELATED APPLICATIONS

Priority is claimed with respect to application No. 98810206.7 filed in the European Patent Office on Mar. 11, 1998, the disclosure of which is incorporated herein by reference.

BACKGROUND OF THE INVENTION

The invention relates to a cutter arrangement for automatically trimming of flat products, such as leaflets, magazines and books, wherein the arrangement includes one or more up and down movable knives, a clamping bar and a fixedly installed counter-knife associated with each cutting knife, and comprising a transporting device for the continued transport of the leaflets, magazines and books.

Cutters of this type have long been known and have generally proven effective in practical operations. The operating principle for such cutters is disclosed in the applicant's prior 1959 Swiss Patent No. CH-A-34 04 79. The cutter disclosed therein comprises an up and down movable cutting unit with three knives distributed over two cutting stations arranged one after another with respect to the movement direction of the leaflets, such that a frontal cut can be executed with one knife and that top and bottom cuts can respectively be executed with the other two knives. The cutting unit, the transporting device and movable end stops are connected to a joint drive mechanism. Despite modifications to individual parts of this cutter, the basic design has to date remained unchanged. Such cutters are also referred to as trimmers or automatic three side trimmers. They permit an automatic trimming even of thick paper products with a capacity of, for example, six copies per second. The cut performed by the knives is also called a scissoring cut and is executed in that the cutting knife moves above the cutting edge of the counter-knife. One advantage of this type of cut is the long service life of the knives, which is considerably longer when compared to a cutting with the aid of cutting strips. However, an exact knife guidance is required. In addition, two stations are absolutely necessary for trimming products on three sides.

With the aforementioned cutter, the force flow is comparably unfavorable and deformations cannot be avoided. The control movements are furthermore complicated and only a comparably light press-down force is possible. Finally, accessibility is limited and lubrication is very involved.

SUMMARY OF THE INVENTION

It is an object of the invention to provide a cutter of the aforementioned type, which avoids the previously mentioned disadvantages, but is still operative and can be produced economically.

The above and other objects of the invention are accomplished in accordance with the invention by the provision of a cutter arrangement for automatically trimming flat products, such as leaflets, magazines and books transported along a horizontal path, comprising: a clamping mechanism positioned along the path for clamping the products, respectively, during a trimming operation; a counter-knife fixedly positioned above the horizontal path in a location corresponding to the position of the clamping mechanism and having a cutting edge; and an up and down movable knife coordinated with the clamping mechanism and positioned below the horizontal path beneath the counter-knife, the movable knife having a cutting edge for cooperating with the cutting edge of the counter-knife during an upward movement of the movable knife for trimming a respective one of the flat products clamped by the clamping mechanism.

According to a further aspect of the invention, the cutter arrangement includes at least first and second cutting stations, with each station comprising at least one clamping mechanism, counter-knife and movable knife arranged as above, with one of the first and second cutting stations performs a cutting operation transverse to a direction of movement of the products along the horizontal path and the other of the first and second cutting stations performs a trimming operation transverse to the direction of movement of the products along the horizontal path, and a transport mechanism is provided to transports the products from the first cutting station to the second cutting station.

The object of the invention is thus achieved in that the up and down movable knives are arranged underneath the counter-knives so that they can be moved from below against the counter-knives to perform the trimming operation. That is, in contrast to heretofore state of the art devices, the cutting knives according to the invention are not arranged above the fixedly installed counter-knives, but below them. This results in the following, numerous advantages:

All movable parts can be arranged inside an oil bath, without the danger of dirtying the products through oil dripping down. Consequently, the knife guides can be lubricated optimally with oil, which results in a considerable reduction in wear and tear as well as knife play.

The counter-knives can be pivoted away easily with the aid of a support, thereby making it easier to gain access to the knives for replacement and also reducing the danger of injury.

An adjustment of the counter-knives relative to the cutting knives is much easier than has been possible in that the support is displaced horizontally.

The cutting knives can be removed easily from above, without the danger of sustaining an injury.

Since no cutting forces are transmitted via the frame, a considerably higher clamping force is possible, owing to a more direct force flow with a simultaneously lighter machine frame.

Since a knife yoke, which heretofore has always been arranged above the transport belts, is omitted, a better view of the transport during the cutting operation is possible, which consequently permits a quicker and easier adjustment.

Due to the fixed arrangement of the counter-knives above the product, the thickness of the products does not affect the position or height of the upper belt. The device for adjusting the upper belt height consequently can have a simpler design.

Dangerous compression locations in the region of the end stops as well as the cutting transport can be secured locally, so that it is possible to make an adjustment without an additional protective cover or risk of injury.

Omitting the yoke for the knives furthermore has the advantage that the design height can be reduced, e.g. by 300 mm.

Finally, a much simpler design can be realized for a vacuum duct used to remove the trimmings, making it possible to eliminate the comparably large cover which was previously necessary.

Additional advantageous features will be apparent from the following detailed description of the invention when considered in conjunction with the accompanying drawings.

BRIEF DESCRIPTION OF THE INVENTION

DETAILED DESCRIPTION OF THE INVENTION

Figure 1:
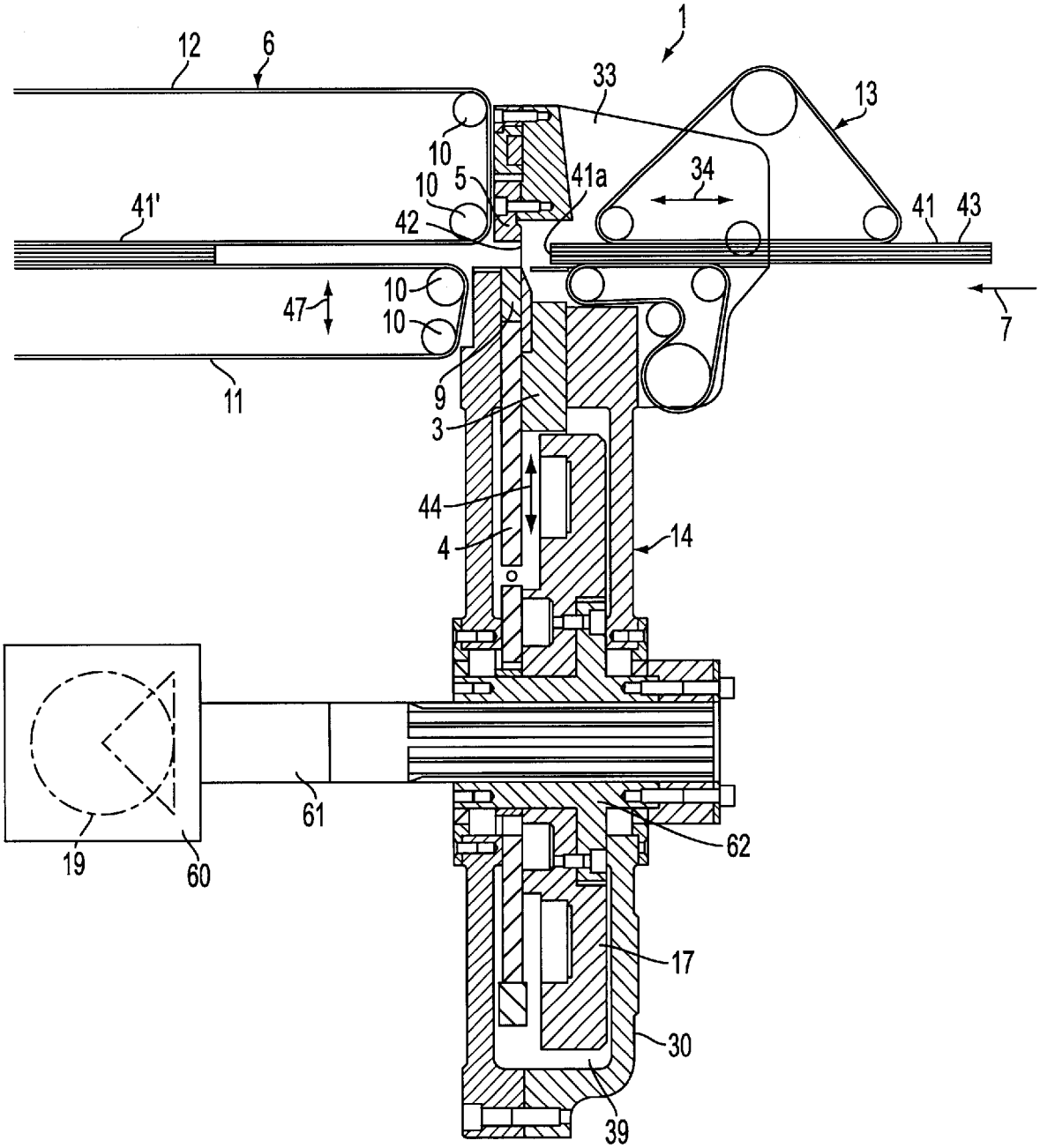
FIG. 1 is a schematic vertical section, in a direction of transport of the flat product, through a cutter of a first cutter station according to the invention, wherein individual parts are left out to make the drawing easier to understand.
Figure 2:
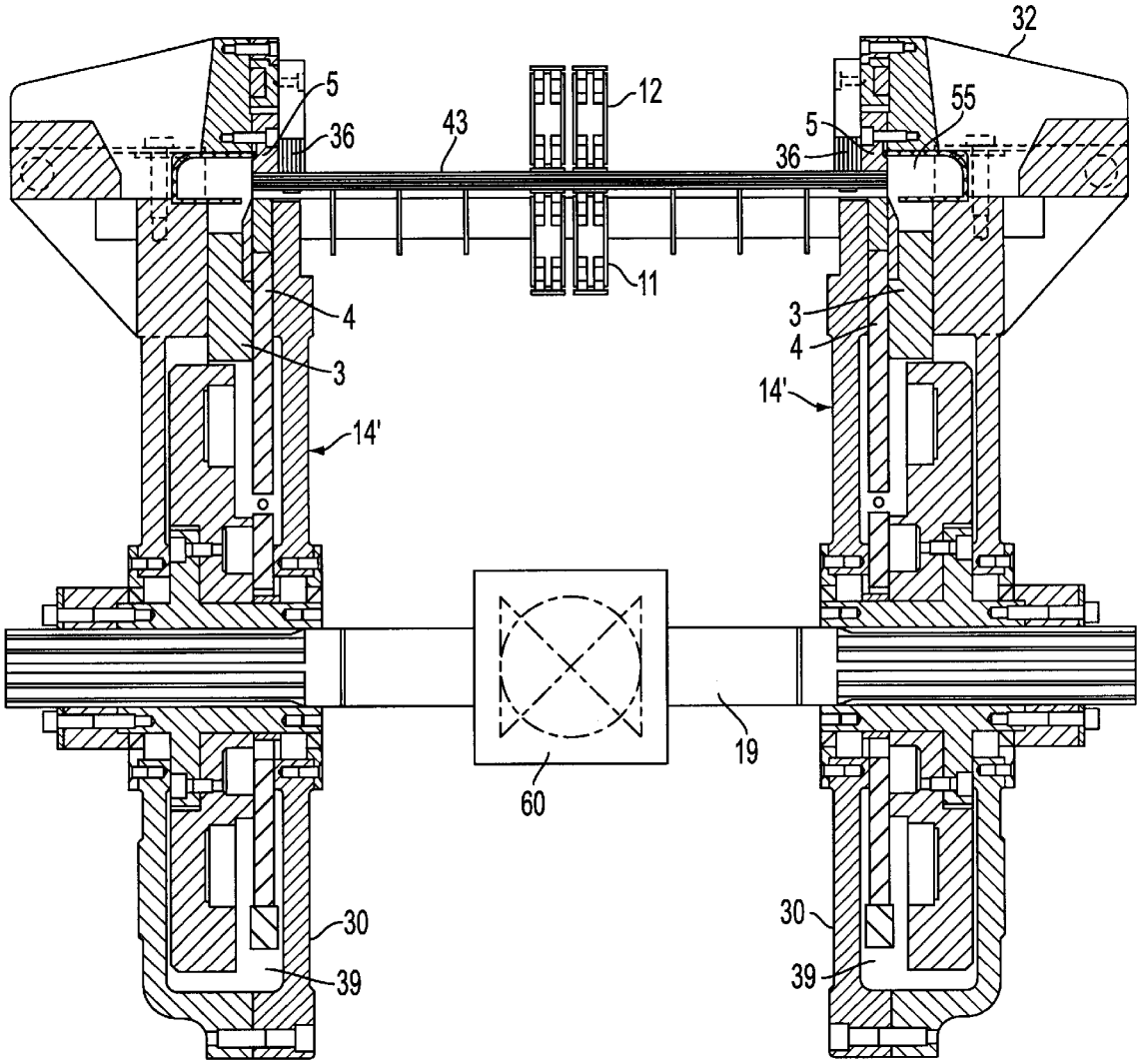
FIG. 2 is a schematic vertical section, transverse to the direction of transport of flat product, through the cutters of a second cutter station according to the invention.

Referring to FIG. 1, there is shown a cutter 1 according to the invention with a belt conveyor 13 feeding feed flat products 41 along a horizontal path to be cut individually. The transporting direction is indicated by arrow 7. FIG. 1 shows a product 41 approaching cutter 1 with its back 41*a* forward to the cutter. A transporting device 6, which includes lower belts 11 and upper belts 12 deflected via rollers 10, is provided for the transport of products 41 inside cutter 1. Transporting device 6 transports products 41 from a first cutting station to a second cutting station. In the first cutting station, a frontal cut is respectively executed by a cutting unit 14 shown in FIG. 1. In the second cutting station, a top cut and a bottom cut are respectively executed with two additional cutting units 14'. These additional cutting units 14' are shown in FIG. 2. The cutting units 14 and 14' have essentially the same design. However, the cutting unit 14 extends crosswise to the transporting direction 7, whereas the cutting units 14' are arranged parallel to the transporting direction 7 and at a distance from each other. Each cutting unit 14 and 14' is respectively coordinated with a fixed counter-knife 5. Of course, transport device 6 is matched to the transport on belt conveyor 13. End stops 58 (see FIG. 5) and means for aligning products 41, which are not shown here, are provided for the two aforementioned cutting stations. As shown in FIG. 2, brushes 36, which rest on the top of products 41, are provided to prevent the products 41 from dropping back at the end stops.

It is essential that the respective counter-knives 5 are secured immovably in a holder, such that their cutting edges 42 respectively face downward and are located above the product 41 to be cut. The counter-knives 5 are thus respectively arranged above a cutting unit 14 and 14'. In this way, the cutting units 14 and 14' execute an upward directed cut, and the products 41 are respectively pushed with their top sides 43 against the counter-knives 5. FIG. 1 shows this arrangement for the frontal cut. As can be seen, the cutting edge 42 of counter-knife 5 is arranged above and the cutting edge 9 of cutting unit 14 is arranged below. For the frontal cut, the cutting edge 9 can be moved upward until it overlaps with the cutting edge 42 and then back again. In FIG. 1, the frontal cut has already been executed on the product 41' and, following the complete withdrawal of the cutting edge 9, another product 41 is shown being supplied by belt conveyor 13 to transport to effect a frontal cut by cutter 14, after which transport device 6 conveys the product to the next cutting station for top and bottom cuts by cutters 14'.

The cutting units 14 and 14' each have respectively one bearing housing 30, which forms a tub with an oil-filled interior space or chamber 39. This inside space 39 contains respectively one knife 3 and one clamping bar 4. Each knife 3 is coordinated with a clamping bar 4. Both can be moved vertically up and down, respectively in the directions of double arrow 44.

Figure 3:
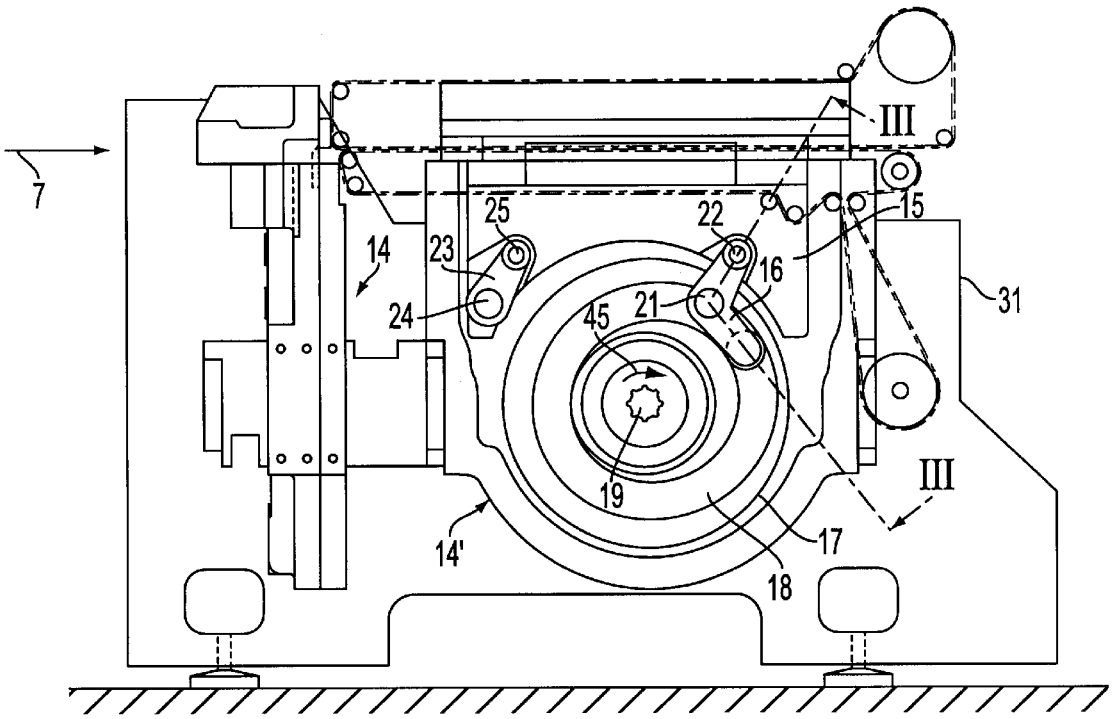
FIG. 3 is an additional schematic vertical section, in the direction of transport of product, through a cutter including the cutter drive mechanism according to the invention.
Figure 4:
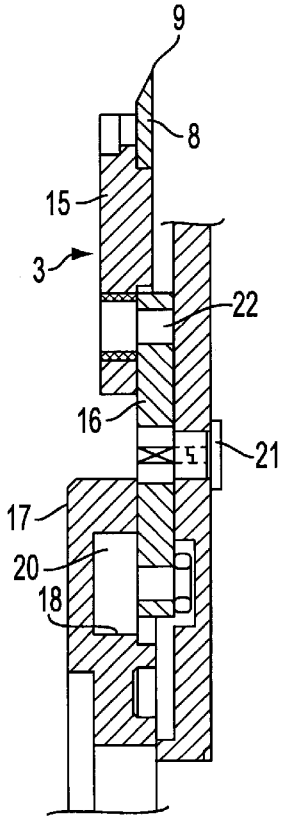
FIG. 4 is a partial section along the line III—III of FIG. 3.

FIGS. 3 and 4 schematically illustrate a drive for the lifting movement of a knife 3, which in this case performs a top cut. A cam disk 17 is positioned inside a machine frame 31 and is driven by means of a main shaft 19 in the direction of arrow 45. In order to carry out a swing cut by a crank-mechanism, a support 15 for knife 3 is positioned inside the machine frame 31. In addition, support 15 is guided on a one-arm lever 23, which can pivot to a limited degree around a shaft 24, rigidly secured to the frame, and is connected with a revolving joint 25 to support 15. A further lever 16, designed as a two-arm angle lever, engages with the aid of a cam roller 20 in a control cam 18 of cam disk 17. Lever 16 is positioned such that it can pivot around a fixed arbor 21 on bearing housing 30 for machine frame 31 and is connected via a joint 22 to support 15. FIG. 3 shows the upper position of knife 3. Control cam 18 is designed such that when cam disk 17 turns farther in the direction of arrow 45, the lever 16 is pivoted clockwise around fixed arbor 21. Knife 3 with the cutting blade 8 is thereby moved downward to a specified lower position. Following a rotation of 180° of the cam disk, lever 16 is pivoted counter-clockwise and the knife 3 is moved upward again to execute the cut. Knife 3 is thus moved up and down continuously to execute the swing cut movement. A cut is made during each vertical upward movement, wherein cutting edge 9 cooperates with the cutting edge 42 of counter-knife 5 and overlaps this knife. The moving parts of the knife drive, meaning in particular levers 16 and 23 and cam disk 17 in this case, are positioned in the oil inside chamber 39. Since cutting knives 8 are located above the oil bath, a soiling of products 41 through dripping oil is not possible. The drive for clamping bar 4 can essentially be the same as the drive for knives 3, explained above with the aid of FIG. 3. However, it is critical that respective knife 3 and clamping bar 4 can be configured as a compact cutting unit 14 or 14'. Clamping bars 4 are controlled such that when executing a cut, products 41 are first pressed against the counter-knife 5 or the counter-knives 5 and are subsequently trimmed. A yoke between the cutting units 14 and 14' is not needed. As a result of this, a very short and positive force flow is possible for the lifting.

According to FIG. 1, main shaft 19 is connected by a cross coupling 60 to a shaft 61, which engages fixedly connected in a hub 62 of cam disk 17 of cutting unit 14. The cutting units 14 and 14' thus are driven jointly. However, individual drives are also conceivable.

Counter-knives 5 are respectively positioned in a support 32, 33. Each of the supports can be displaced horizontally in the directions of double arrow 34 and thus can be adjusted precisely, relative to the cutting knives 8. A shown in FIG. 5, support 32 has an elongated aperture 50, into which a shaft 51 that is rigidly secured to the frame engages. In addition, supports 32 are attached to frame 31 so that together with the counter-knife they can pivot away from blade 9, respectively, in the direction of arrow 35. As a result of this, the knives 8 can be accessed easily for replacement. Supports 32 furthermore cover the cutting locations and protect against an injury.

Owing to the fixed arrangement of counter-knives 5 above products 41, the thickness of products 41 does not influence the position of upper belts 12. Consequently, upper belts 12 do not have to be vertically adjustable to take into account the thickness of products 41, as the case has been in the past. Thus, the device for the vertical adjustment of upper belts 12, which is required to interrupt the transport, can have a comparably simple design. Devices for the vertical adjustment of the upper belts, as well as suitable belt drives and controls, are known to the person skilled in the art and are therefore not explained in further detail here.

In order to adapt to the thickness of products 41, the lower belts 11 on a device (not shown here) are positioned such that they can be vertically adjusted in the direction of double arrow 47 (FIG. 1). Such adjustment devices are known per se to the person skilled in the art and are therefore not here explained further. However, separating this adjustment option from the lift of upper belts 12 represents a considerable simplification of the design. Until now, both functions had to be integrated into upper belts 12.

Figure 5:
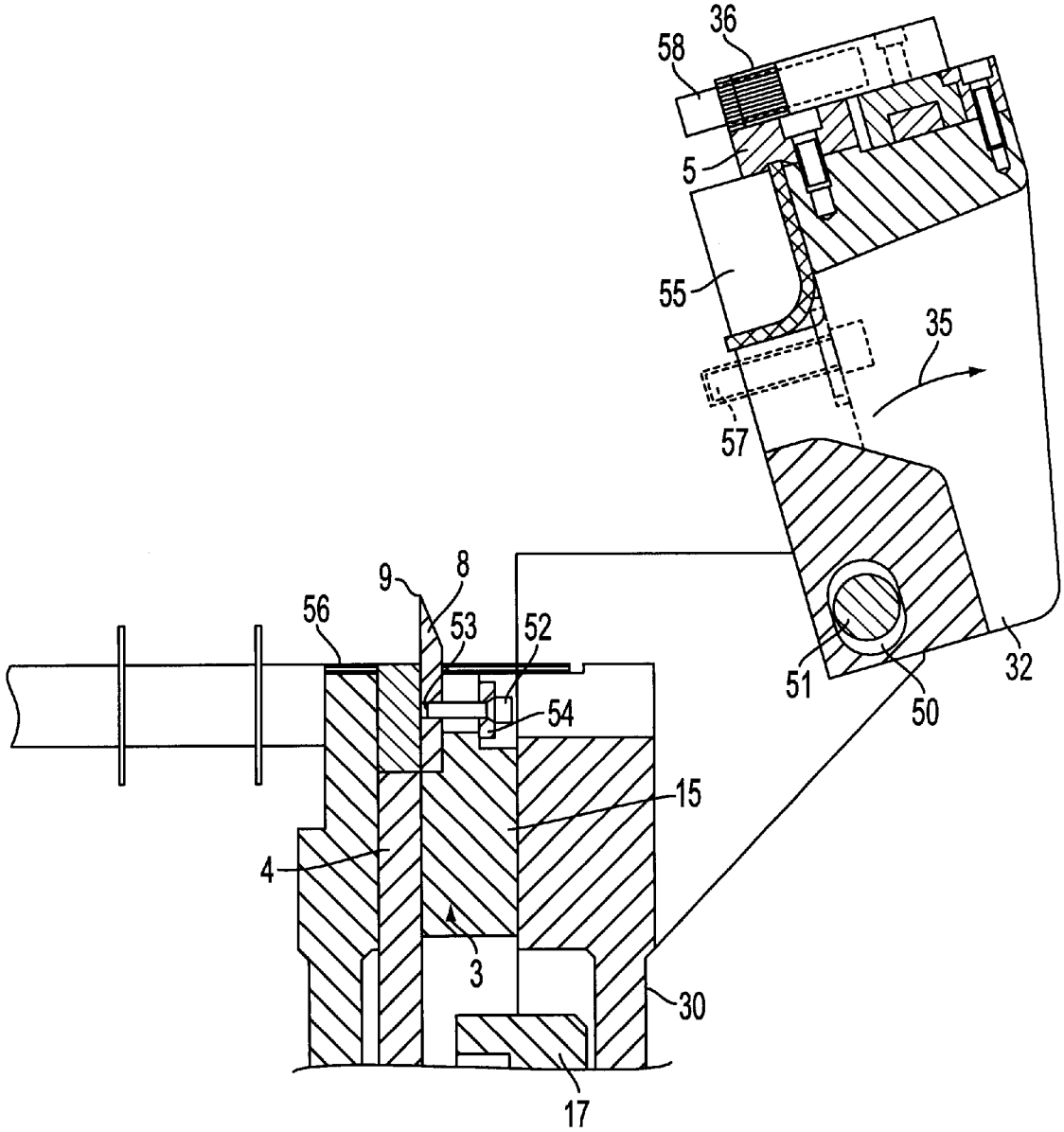
FIG. 5 is a schematic representation of a partial section through the cutter according to the invention.

As shown in FIG. 5, each cutting knife 8 is attached with a fastening screw 52 to its support 15, so that the cutting knife can be replaced. Fastening screw 52 engages in a threaded bore 53 of cutting knife 8 and its head is supported on a washer 54. In order to replace cutting knife 8, support 32 is pivoted to the position shown in FIG. 5 and fastening screw 52 is unscrewed from thread bore 53 until cutting knife 8 can be lifted off knife support 15. A new cutting knife 8 can be easily fastened on support 32 in the same way by using a screw 52. Support 32 also has a vacuum duct 55, which extends along the cutting knife 8 and is connected to a vacuum device not shown here. A plate 56 is attached to bearing housing 30 to seal duct 55. If support 32 is fastened with a tension screw 57 on bearing housing 30, as shown in FIG. 2, the material trimmed off during each cutting operation, which is not shown here, will be deposited in duct 55 and removed via this duct.

The invention has been described in detail with respect to preferred embodiments, and it will now be apparent from the foregoing to those skilled in the art, the changes and modifications may be made without departing from the invention in its broader aspects, and the invention, therefore, as defined in the appended claims, is intended to cover all such changes and modifications as to fall within the true spirit of the invention.

What is claimed is:

1. A cutter arrangement for automatically trimming flat products transported along a horizontal path, comprising:

a clamping mechanism positioned along the path for clamping the products, respectively, during a trimming operation;

a counter-knife positioned above the horizontal path in a location opposite to the position of the clamping mechanism and having a cutting edge and being held in a stationary position during the trimming operation; and a cutting unit comprising:

an up and down movable knife coordinated with the clamping mechanism and positioned below the horizontal path beneath the counter-knife, the movable knife having a cutting edge for cooperating with the cutting edge of the counter-knife during an upward movement of the movable knife for trimming a respective one of the flat products clamped by the clamping mechanism;

an oil pan; and movable parts that are positioned in the oil pan; and a transporting device for providing a continued transport of the products along the horizontal path following a trimming operation;

wherein the cutting unit includes the clamping mechanism and the clamping mechanism comprises a clamping bar operatively arranged with the movable knife; and wherein the cutter arrangement includes first and second cutting stations each comprising at least each of the clamping mechanism, the counter-knife and the movable knife arranged such that one of the first and second cutting stations perform a cutting operation of top and bottom edges of the products along the horizontal path and the other of the first and second cutting stations performs a trimming operation of a front edge the products along the horizontal path, and the transport mechanism transports the products from the first cutting station to the second cutting station.

2. A cutter arrangement according to claim 1, and further including a support mounting the counter-knife and pivoting, with the counter-knife, away from the horizontal path.

3. A cutter arrangement according to claim 2, wherein the support is displaceable horizontally for adjusting a horizontal position of the counter-knife relative to the cutting knife.

4. A cutter arrangement according to claim 1, wherein the movable parts constitute components of a drive mechanism coupled to the movable knife for moving the movable knife up and down.

5. A cutter arrangement according to claim 4, wherein the drive mechanism causes the knife to perform a swing cut.

6. A cutter arrangement for automatically trimming flat products transported along a horizontal path, comprising:

a clamping mechanism positioned along the path for clamping the products, respectively, during a trimming operation;

a counter-knife positioned above the horizontal path in a location opposite to the position of the clamping mechanism and having a cutting edge and being held in a stationary position during the trimming operation; and a cutting unit comprising:

an up and down movable knife coordinated with the clamping mechanism and positioned below the horizontal path beneath the counter-knife, the movable knife having a cutting edge for cooperating with the cutting edge of the counter-knife during an upward movement of the movable knife for trimming a respective one of the flat products clamped by the clamping mechanism;

an oil pan; and movable parts that are positioned in the oil pan; and a transporting device for providing a continued transport of the flat products along the horizontal path following a trimming operation;

wherein the cutting unit includes the clamping mechanism and the clamping mechanism comprises a clamping bar operatively arranged with the movable knife.

* * * * *